US005491043A

United States Patent [19]

Dix et al.

[11] Patent Number: 5,491,043

[45] Date of Patent: Feb. 13, 1996

[54] ELECTROSTATIC TONERS WITH POLYAMINE CHARGE STABILIZERS

[75] Inventors: Johannes P. Dix, Weisenheim; Ulf Baus, Dossenheim; Karin H. Beck; Friedrich-Wilhelm Raulfs, both of Ludwigshafen, all of Germany

[73] Assignee: BASF Aktiengesellschaft, Ludwigshafen, Germany

[21] Appl. No.: 245,559

[22] Filed: May 18, 1994

[30] Foreign Application Priority Data

May 21, 1993 [DE] Germany ..... 43 17 059.5

[51] Int. Cl.[6] ..... G03G 9/097

[52] U.S. Cl. ..... 430/110; 430/109; 430/904

[58] Field of Search ..... 430/110, 109, 430/904; 525/540

[56] References Cited

U.S. PATENT DOCUMENTS

| | | | |
|---|---|---|---|
| 3,705,200 | 12/1972 | Bunting et al. | 360/668 |
| 3,758,580 | 9/1973 | Lancer et al. . | |
| 3,951,835 | 4/1976 | Tomono et al. | 430/110 |
| 4,068,058 | 1/1978 | Engel et al. . | |
| 4,265,990 | 5/1981 | Stolka et al. . | |
| 4,455,361 | 6/1984 | Narusawa et al. | 260/109 |
| 4,539,282 | 9/1985 | Morimoto et al. | 430/59 |
| 4,701,389 | 10/1987 | Morimoto et al. | 430/110 |
| 5,009,979 | 4/1991 | Buxton et al. | 430/110 |
| 5,332,640 | 7/1994 | Duff et al. | 430/110 |
| 5,334,470 | 8/1994 | Shimada et al. | 430/59 |
| 5,344,734 | 9/1994 | Monbaliu et al. | 430/110 |

FOREIGN PATENT DOCUMENTS

| | | |
|---|---|---|
| 0163528 | 12/1985 | European Pat. Off. . |
| 0201340 | 11/1986 | European Pat. Off. . |
| 242420 | 10/1987 | European Pat. Off. . |
| 2253594 | 5/1973 | Germany . |
| 2531458 | 1/1976 | Germany . |
| 2606823 | 9/1976 | Germany . |

OTHER PUBLICATIONS

Alger, Mark. *Polymer Science Dictionary*, Essex England: Elsevier Science Publishing, Ltd. (1989) p. 326.

Patent Abstracts Of Japan, vol. 8, No. 10 (P–248)(1447), Jan. 18, 1984, JP–A–58 171 060, Oct. 7, 1983.

Patent Abstracts Of Japan, vol. 10, No. 41 (P–429)(2098), Feb. 18, 1986, JP–A–60 188 958, Sep. 26, 1985.

Patent Abstracts Of Japan, vol. 14, No. 50 (P–998)(3993), Jan. 30, 1990, JP–A–01 279 258, Nov. 9, 1989.

*Primary Examiner*—Christopher D. Rodee

*Attorney, Agent, or Firm*—Oblon, Spivak, McClelland, Maier & Neustadt

[57] ABSTRACT

An electrostatic toner contains a polymeric binder and as a charge stabilizer a polyamine whose average molecular weight is from 150 to 15,000 and wherein the nitrogen atoms are separated from each other by $C_1$-$C_{13}$- alkylene, which may be phenyl-substituted, or by phenylene, which may be $C_1$-$C_4$-alkyl-substituted, and are substituted by $C_1$-$C_{13}$-alkyl, which may be phenyl-, hydroxyl- or carboxyl-substituted, phenyl, $C_1$-$C_{10}$-alkanoyl, benzoyl, $C_1$- $C_6$- alkylcarbamoyl, phenylcarbamoyl or a radical of the formula CO-L-CO, where L is $C_2$-$C_8$-alkylene, the last case resulting in the crosslinking of two polyamine units.

11 Claims, No Drawings

ELECTROSTATIC TONERS WITH POLYAMINE CHARGE STABILIZERS

The present invention relates to novel electrostatic toners comprising a polyeric binder and a charge stabilizer that is a polyamine whose average molecular weight is from 150 to 15,000 and wherein the nitrogen atoms are separated from each other by $C_1$-$C_{13}$-alkylene, which may be phenyl-substituted, or by phenylene, which may be $C_1$-$C_4$-alkyl-substituted, and are substituted by $C_1$-$C_{13}$-alkyl, which may be phenyl-, hydroxyl- or carboxyl-substituted, phenyl, $C_1$-$C_{10}$-alkanoyl, benzoyl, $C_1$-$C_6$-alkylcarbamoyl, phenylcarbamoyl or a radical of the formula CO-L-CO, where L is $C_2$-$C_8$-alkylene, the last case resulting in the crosslinking of two polyamine units, and to the use of the abovementioned polyamines as charge stabilizers in electrostatic toners.

Latent electrostatic image recordings are developed by inductively depositing the toner on the electrostatic image. The charge stabilizers stabilize the electrostatic charge of the toner. This makes the image stronger and crisper.

The charge stabilizers used have to meet various requirements:

ability to develop the latent electrostatic image to form a strong visible image.

ease of dispersion in the toner preparation to produce a fault-free, crisp, uniform image.

imperviousness to moisture.

high thermal stability.

EP-A-242 420 discloses electrostatic toners with amine or ammonium salt charge stabilizers.

However, it has been found that the prior art charge stabilizers frequently have defects in their requirement profile.

It is an object of the present invention to make available novel electrostatic toners with charge stabilizers having advantageous application properties.

We have found that this object is achieved by the electrostatic toners defined at the beginning.

All alkyl and alkylene radicals appearing in the polyamines can be not only straight-chain but also branched.

Suitable alkyl radicals include for example methyl, ethyl, propyl, isopropyl, butyl, isobutyl, secbutyl, pentyl, isopentyl, neopentyl, tert-pentyl, hexyl, 2-methylpentyl, heptyl, 2-methylhexyl, octyl, isooctyl, 2-ethylhexyl, nonyl, isononyl, decyl, isodecyl, undecyl, dodecyl, tridecyl, isotridecyl,-benzyl, 1- or 2-phenylethyl, 2-hydroxyethyl, 2- or 3-hydroxypropyl, 1-carboxyethyl or 2-carboxypropyl. (The above designations isooctyl, isononyl, isodecyl and isotridecyl are derived from the oxo process alcohols—cf. Ullmanns Encyclopädie der technischen Chemie, 4th Edition, Volume 7, pages 215 to 217, and Volume 11, pages 435 and 436.)

Suitable alkylene radicals are $(CH_2)_2$, $(CH_2)_3$, $(CH_2)_4$, $(CH_2)_5$, $(CH_2)_6$, $(CH_2)_7$, $(CH_2)_8$, $(CH_2)_9$, $(CH_2)_{10}$, $(CH_2)_{11}$, $(CH_2)_{12}$, $(CH_2)_{13}$, $CH(CH_3)CH_2$, $CH(CH_3)CH(CH_3)$, $CH(C_6H_5)CH_2$ or $CH(C_6H_5)CH(C_6H_5)$.

Suitable phenylene radicals are for example 1,2-, 1,3-, 1,4-phenylene, 2-methyl-1,4-phenylene and 2,5-dimethyl-l, 4-phenylene.

Suitable alkanoyl radicals are for example formyl, acetyl, propionyl, butyryl, isobutyryl, pentanoyl, isopentanoyl, hexanoyl, heptanoyl, octanoyl, 2-ethylhexanoyl, nonanoyl or decanoyl.

Suitable alkylcarbamoyl radicals are for example methylcarbamoyl, ethylcarbamoyl, propylcarbamoyl, isopropylcarbamoyl, butylcarbamoyl, isobutylcarbamoyl, pentylcarbamoyl, isopentylcarbamoyl, neopentylcarbamoyl or hexylcarbamoyl.

Preference is given to electrostatic toners with a polyamine whose average molecular weight is from 400 to 4,000.

Preference is further given to electrostatic toners with a polyamine having at least three nitrogen atoms. Such polyamines generally contain different proportions of primary, secondary and tertiary nitrogen atoms.

Preference is further given to electrostatic toners with a polyamine in which the nitrogen atoms are separated from each other by $C_2$-$C_4$-alkylene.

Preference is further given to electrostatic toners with a polyamine in which the nitrogen atoms are substituted by $C_1$-$C_{13}$-alkyl.

Particular preference is given to electrostatic toners with a polyamine in which the nitrogen atoms are separated from each other by ethylene or 1,2- or 1,3-propylene, in particular ethylene.

Particular preference is further given to electrostatic toners with a polyamine in which the nitrogen atoms are substituted by $C_1$-$C_{13}$-alkyl.

The abovementioned polyamines are generally known per se or can be obtained by known methods, as described in U.S. Pat. No. 3,705,200, DE-A-2,253,594 or DE-A-2,606,823.

They can be obtained for example by reacting parent polyamine species with alkylating or acylating substances which will increase the degree of substitution of the primary and secondary nitrogen atoms of the parent species. Suitable alkylating substances are all those which undergo an exchange reaction with the NH groups of the parent species and contain for this purpose a substitutable group, for example sulfate, halogen, hydroxyl or acetate. It is also possible for example to use those substances which contain an activated double bond, such as acrylic acid or styrene, or a reactive group such as an oxirane ring. It is also possible to use acylating reagents such as carboxylic acids, carboxylic esters or isocyanates, since they are likewise able to increase the degree of substitution of the primary and secondary nitrogen atoms of the parent species.

Particular preference is given to those reagents which themselves contain substituted nitrogen atoms and react readily with the nitrogen atoms of the parent species to convert the bulk of the primary and secondary amine functions in the parent species into tertiary amine functions. Particularly suitable are for example dialkyl-hydroxyalkylamines whose alkyl groups contain from 1 to 13 carbon atoms, which can be bonded to one another in linear, branched or cyclic fashion. They react with the parent polyamine species by elimination of water.

The corresponding parent polyamine species can be prepared for example in a conventional manner by customary condensation, addition or substitution reactions from ammonia or amines and corresponding reactants, for example by reacting ammonia with ethylene dichloride or propylene dichloride. They can also be prepared by partial acylation of the nitrogen atoms using appropriate carboxylic acids. Particularly preferred parent species are those which are obtained for example by polymerization of aziridine.

The proportion of the above-defined polyamines in the electrostatic toner is generally from 0.01 to 10% by weight, based on the weight of the toner.

The polymeric binders present in the novel electrostatic toners are known per se. They are generally thermoplastic and have a softening point from 40° to 200° C., preferably from 50° to 130° C., in particular from 65° to 115° C. Examples of polymeric binders are polystyrene, copolymers of styrene with an acrylate or methacrylate, copolymers of styrene with butadiene and/or acrylonitrile, polyacrylates, polymethacrylates, copolymers of an acrylate or methacrylate with vinyl chloride, vinyl acetate, polyvinyl chloride, copolymers of vinyl chloride with vinylidene chloride, copolymers of vinyl chloride with vinyl acetate, polyester resins, epoxy resins, polyamides and polyurethanes.

In addition to the abovementioned polyamines and the polymeric binders, the toners of the invention may contain known amounts of colorants, magnetically tractable material, waxes and free-flow agents.

The colorants can be organic dyes or pigments, such as nigrosine, aniline blue, 2,9-dimethylquinacridone, C.I. Disperse Red 15 (C.I. 6010), C.I. Solvent Red 19 (C. I. 26 050), C.I. Pigment Blue 15 (C. I. 74 160), C.I. Pigment Blue 22 (C.I. 69 810) or C.I. Solvent Yellow 16 (C.I. 12 700) or inorganic pigments such as carbon black, lead red, yellow lead oxide or chromium yellow. Generally, the amount of colorant present in the toner does not exceed 15% by weight, based on the weight of the toner.

The magnetically tractable material can be for example iron, nickel, chromium oxide, iron oxide or a ferrite of the formula $MeFe_2O_4$, where Me is a bivalent metal, e.g. iron, cobalt, zinc, nickel or manganese.

The toners of the invention are prepared in a conventional manner, for example by mixing the ingredients in a kneader and then pulverizing or melting the polymeric binder or a mixture of polymeric binders, then finely dispersing one or more of the above-defined polyamines and the other additives, if used, in the molten resin using the mixing and kneading machines known for this purpose, then cooling down the melt to form a solid mass and finally grinding the solid mass to particles of the desired particle size (generally from 0.1 to 50 μm). It is also possible to suspend the polymeric binder and the charge stabilizer in a common solvent and to add the other additives to the suspension. In this way the suspension can be used as a liquid toner.

However, the liquid can also be spray-dried in a conventional manner, or the solvents can be evaporated off or the liquid freeze-dried, and the solid residue ground to particles of the desired size.

It is also possible not to dissolve the polyamine charge stabilizers but to disperse them finely in the solution of the polymeric binder. The toner preparation thus obtained can then be used in a xerographic image recording system, for example as described in US-A-4,265,990.

The above-defined polyamines are advantageous charge stabilizers. Generally they meet the property profile stipulated at the beginning and are particularly notable for the fact that, when added to a toner preparation, they confer on it an advantageous electrostatic chargeup profile; that is, the toners can be charged up quickly and to a high level. The charge stabilizers of the invention also have the effect that the charge is kept constant at a high level.

The examples which follow illustrate the invention.

A) Preparation of polyamines

EXAMPLE P1

277.3 g (1.6 mol) of N,N-dibutyl-N-(2-hydroxyethyl)amine were mixed at room temperature with 69.6 g (1.28 mol) of polyethyleneamine (average molecular weight: 430) in the presence of 5 g of 50% strength by weight aqueous hyloophosphorous acid. The mixture was heated to 180°–230° C. under nitrogen with stirring. A total of 26.9 g of water and 15.1 g of N,N-dibutyl-N-(2-hydroxyethyl)amine distilled off. The residue (a viscous oil) was incorporated into the toner when cold.

Example P1 was repeated with varying polyethyleneamines and varying amounts, but using N,N-dibutyl-N-(2-hydroxyethyl)amine in each case

TABLE 1

| | Polyethylenamine | | Amine | Amount of distilled | |
|---|---|---|---|---|---|
| Ex. No. | molecular weight | amount [g] | amount [g] | water [g] | Yield [g] |
| P2 | 860 | 94.5 | 260 | 18.5 | 314 |
| P3 | 860 | 113.4 | 234 | 16.7 | 308 |
| P4 | 1500 | 96.6 | 260 | 21.2 | 313 |
| P5 | 1500 | 82.4 | 277.3 | 23.5 | 308 |
| P6 | 430 | 69.6 | 277.3 | 24.4 | 303 |

B) Use

The use examples were carried out with colorant-free toner models consisting of resin and the charge stabilizers of the invention.

I. Preparation of toners

EXAMPLE U1

A solution of 10 g of non-crosslinked styrene/butyl acrylate resin in 100 ml of xylene was admixed at room temperature with 0.2 g of the polyamine of Example P1 and then freeze-dried.

EXAMPLE U2

In a mixer 10 g of a non-crosslinked styrene/butyl acrylate resin and 0.2 g of the polyamine of Example P1 were intensively mixed, headed at 120° C., extruded and ground. Classification was employed to obtain toner particles having an average particle size of 50 μm.

II. Preparation of developers and testing

To prepare a developer 99% by weight of a steel carrier having an average particle size of 100 μm was weighed out accurately together with 1% by weight of the toner and activated on a roll stand for a certain period as specified hereinafter. Then the electrostatic charge on the developer was determined. About 5 g of the activated developer were introduced in a commercial q/m meter (from Epping GmbH, Neufahrn) into a hard blowoff cell electrically connected to an electrometer. The mesh size of the screens used in the measuring cell was 80 μm.

This ensured a maximumblowout of the toner while the carrier remained in the measuring cell. A fast airstream (about 4000 cc/min) with simultaneous aspiration was employed to remove the toner almost completely from the carrier particles with the latter remaining in the measuring cell. The charge on the carrier was recorded by the electrometer. It corresponded to the amount of charge on the toner particles except for the opposite sign. To calculate the q/m value, therefore, the amount of q of the opposite sign was used. The measuring cell was weighed back to determine the mass of blown-out toner and hence the electrostatic charge q/m.

The charge determined on the toners is summarized below in table 2:

TABLE 2

| Example No. | Compound of example | Preparation of toner* | Charge following activation for 10 min | 30 min | 60 min | 120 min |
|---|---|---|---|---|---|---|
| | | | [μC/g] | | | |
| U1 | P1 | F | 9.5 | 8.8 | 7.9 | 7.3 |
| U2 | P1 | K | 6.6 | 6.9 | 6.9 | 6.1 |
| U3 | P2 | F | 5.3 | 5.5 | 4.8 | 4.8 |
| U4 | P3 | F | 6.7 | 6.4 | 5.5 | 5.2 |
| U5 | P4 | F | 6.6 | 6.4 | 6.1 | 5.8 |
| U6 | P5 | F | 7.3 | 6.8 | 7.2 | 7.0 |
| U7 | P5 | K | 4.8 | 5.1 | 4.8 | 3.1 |
| U8 | P6 | F | 6.1 | 6.5 | 6.6 | 6.8 |

*The preparation of the toner was effected either by freeze-drying as per example U1 (identified in the table by "F") or by kneading at a temperature above the softening point of the resin as per example U2 (identified in the table by "K").

We claim:

1. An electrostatic toner, comprising:

a) a polymeric binder; and b) a charge stabilizer, wherein said charge stabilizer is a polyamine having an average molecular weight of 150–15,000, said polyamine having at least three nitrogen atoms wherein adjacent nitrogen atoms are separated from each other by a first radical selected from the group consisting of $C_1$-$C_{13}$-alkylene and phenyl-substituted $C_1$-$C_{13}$-alkylene, said nitrogen atoms being substituted by a second radical selected from the group consisting of $C_1$-$C_{13}$-alkyl, phenyl-substituted $C_1$-$C_{13}$-alkyl, hydroxyl-substituted-$C_1$-$C_{13}$-alkyl, carboxyl-substituted $C_1$-$C_{13}$-alkyl, phenyl, $C_1$-$C_{10}$-alkanoyl, benzoyl, $C_1$-$C_6$-alkylcarbamoyl and phenylcarbamoyl, and said adjacent nitrogen atoms are bonded together by said first radical or nitrogen atoms on two of said polyamines are bonded together through a third radical of the formula CO-L-CO, where L is $C_2$-$C_8$-alkylene.

2. The toner of claim 1, wherein said polyamine has an average molecular weight of 400–4,000.

3. The toner of claim 1, wherein said first radical is selected from the group consisting of $C_2$-$C_4$-alkylene radicals.

4. The toner of claim 3, wherein said first radical is an ethylene radical.

5. The toner of claim 3, wherein said first radical is a 1,2-propylene radical.

6. The toner of claim 3, wherein said first radical is a 1,3-propylene radical.

7. The toner of claim 1, wherein said second radical is selected from the group consisting of $C_1$-$C_{13}$-alkyl radicals.

8. The toner of claim 1, containing 0.01–1% by weight of said polyamine, based on the weight of said toner.

9. The toner of claim 1, wherein said nitrogen atoms are substituted by reacting said nitrogen atoms with a di-$C_{1-13}$-alkylhydroxy-$C_{1-13}$-alkyl amine.

10. The toner of claim 1, wherein said two nitrogen atoms are separated from each other by said first radical which is a $C_1$-$C_{13}$-alkylene group.

11. The toner of claim 1, wherein said two nitrogen atoms are separated from each other by said first radical which is a phenyl-substituted $C_1$-$C_{13}$-alkylene group.

* * * * *